US011488544B2

(12) United States Patent
Park et al.

(10) Patent No.: US 11,488,544 B2
(45) Date of Patent: Nov. 1, 2022

(54) DIGITAL SIGNAGE SYSTEM AND OPERATING METHOD THEREFOR

(71) Applicant: LG ELECTRONICS INC., Seoul (KR)

(72) Inventors: Sangjoon Park, Seoul (KR); Wonsik Kim, Seoul (KR); Sungjin Kang, Seoul (KR); Heeyoung Lim, Seoul (KR); Byungchang Cha, Seoul (KR); Geunyong Kim, Seoul (KR); Myungdeok Bae, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/288,465

(22) PCT Filed: Nov. 6, 2018

(86) PCT No.: PCT/KR2018/013383
§ 371 (c)(1),
(2) Date: Apr. 23, 2021

(87) PCT Pub. No.: WO2020/096076
PCT Pub. Date: May 14, 2020

(65) Prior Publication Data

US 2021/0390915 A1 Dec. 16, 2021

(51) Int. Cl.

| | |
|---|---|
| ***G09G 3/34*** | (2006.01) |
| ***G09G 3/32*** | (2016.01) |
| ***G09G 5/10*** | (2006.01) |

(52) U.S. Cl.
CPC ..... *G09G 3/3406* (2013.01); *G09G 3/32* (2013.01); *G09G 5/10* (2013.01); *G09G 2320/0626* (2013.01); *G09G 2330/02* (2013.01)

(58) Field of Classification Search
CPC ..... G09G 3/3406; G09G 3/32; G09G 5/10; G09G 2320/0626; G09G 2330/02; G09G 2330/021; G09G 2354/00
See application file for complete search history.

(56) References Cited

U.S. PATENT DOCUMENTS 8,850,246 B2 * 9/2014 Lee ..... G09G 3/3406 455/574
9,754,540 B2 * 9/2017 Takesue ..... G09G 3/3413
(Continued)

FOREIGN PATENT DOCUMENTS

JP 2015095133 5/2015
JP 2017204124 11/2017
(Continued)

OTHER PUBLICATIONS

PCT International Application No. PCT/KR2018/013383, International Search Report dated Aug. 5, 2019, 3 pages.

*Primary Examiner* — Vijay Shankar
(74) *Attorney, Agent, or Firm* — Lee, Hong, Degerman, Kang & Waimey PC

(57) ABSTRACT

Disclosed herein are a digital signage system for limiting a luminance range settable by a user according to the number of power supply units (PSUs) and a method of operating the same. The digital signage system includes a panel configured to display an image, a plurality of light emitting diode (LED) driver modules configured to provide to the panel, a display device including at least one power supply unit configured to supply power to the panel and the plurality of LED driver modules, and a system controller configured to control the display device. The system controller includes a display configured to display a luminance setting screen for controlling luminance of the image and a controller configured to change a settable maximum luminance value accord-
(Continued)

ing to the number of power supply units when the luminance setting screen is displayed.

15 Claims, 7 Drawing Sheets

(56) References Cited

U.S. PATENT DOCUMENTS

| | | | | |
|---|---|---|---|---|
| 9,960,190 | B2 * | 5/2018 | Yamazaki | H01L 29/7786 |
| 10,453,401 | B2 * | 10/2019 | Yamazaki | G09G 3/20 |
| 10,515,595 | B2 * | 12/2019 | Seong | G09G 3/3426 |
| 10,607,575 | B2 * | 3/2020 | Iwaki | G09G 5/006 |
| 11,132,959 | B2 * | 9/2021 | Lee | G09G 3/342 |
| 2017/0365234 | A1 * | 12/2017 | Yamazaki | G09G 3/20 |
| 2018/0096670 | A1 * | 4/2018 | Iwaki | G09G 3/3648 |

FOREIGN PATENT DOCUMENTS

| | | |
|---|---|---|
| KR | 20120114624 | 10/2012 |
| KR | 101457360 | 11/2014 |
| KR | 101797523 | 11/2017 |

* cited by examiner

DIGITAL SIGNAGE SYSTEM AND OPERATING METHOD THEREFOR

CROSS-REFERENCE TO RELATED APPLICATIONS

This application is the National Stage filing under 35 U.S.C. 371 of International Application No. PCT/KR2018/013383, filed on Nov. 6, 2018, the contents of which is incorporated by reference herein in its entirety.

TECHNICAL FIELD

The present disclosure relates to a digital signage system and a method of operating the same and, more particularly, to a digital signage system including a plurality of digital signages and a system controller for controlling the plurality of digital signages, and a method of operating the same.

BACKGROUND ART

Digital signage is communication tools capable of inducing marketing, advertising, training effects and customer experience and means digital image apparatuses installed in public places such as airports, hotels, hospitals to provide broadcast programs, specific information, etc. Such digital signage is characterized in that software and management platforms capable of controlling main functions in an existing commercial digital information display (DID) is comprehensively supplied.

Digital signage is also referred to as a video wall and may perform a video wall function using a display device. The video wall function refers to a function for recognizing multiple display devices as one screen and a function for enabling a user to view an image at a glance through a screen displayed on the multiple display devices, by enlarging and displaying portions of the screen on the display devices.

Meanwhile, conventionally, since a plurality of power supply units (PSUs) is installed such that higher luminance than luminance normally used by a user is provided without considering luminance desired by the user when digital signage is installed, there is a problem that price is higher than necessary.

To solve this problem, when digital signage is installed, the number of PSUs may increase or decrease in consideration of maximum luminance desired by a user. At this time, if a luminance setting range is not changed according to the number of PSUs, a user may set higher luminance of an image than luminance capable of being provided by the PSUs and thus overcurrent may flow.

INVENTION

Technical Problem

The present disclosure is to limit a luminance range settable by a user according to the number of power supply units (PSUs).

Technical Solution

A digital signage system according to an embodiment of the present disclosure comprises a panel configured to display an image, a plurality of light emitting diode (LED) driver modules configured to provide light to the panel, a display device including at least one power supply unit configured to supply power to the panel and the plurality of LED driver modules, and a system controller configured to control the display device, wherein the system controller comprises: a display configured to display a luminance setting screen for controlling luminance of the image; and a controller configured to change a settable maximum luminance value according to the number of power supply units when the luminance setting screen is displayed.

The controller is configured to display a luminance range guide bar having a range from 0 to the maximum luminance value when the luminance setting screen is displayed.

The controller is configured to display a luminance range guide bar including a luminance settable range and a luminance unsettable range according to the maximum luminance value when the luminance setting screen is displayed.

The controller is configured to differently display the luminance settable range and the luminance unsettable range.

The controller is configured to display a luminance limit warning window when a command for selecting a luminance value belonging to the luminance unsettable range is received.

The controller is configured to further display a minimum luminance value on the luminance range guide bar, a maximum luminance value on the luminance range guide bar and a settable maximum luminance value.

The controller is configured to display a luminance setting screen according to a high luminance mode or a luminance setting screen according to a low luminance mode based on the number of the plurality of LED driver modules and the number of power supply units.

The controller is configured to: calculate a maximum luminance level among luminance levels at which total power consumed by the plurality of LED driver modules is equal to or less than total power supplied by the at least one power supply unit, display a luminance setting screen according to a high luminance mode when the calculated maximum luminance level is equal to or greater than a reference value, and display a luminance setting screen according to a low luminance mode when the calculated maximum luminance level is less than the reference value.

The controller is configured to display a luminance setting screen for limiting a settable maximum luminance value when the luminance setting screen according to the high luminance mode is displayed.

The controller is configured to: display a selectable luminance setting screen in a range from 0 to 100 when the luminance setting screen according to the low luminance mode is displayed, and adjust current supplied to the plurality of LED driver modules by the power supply unit.

The controller adjusts current supplied to the plurality of LED driver modules by the power supply unit to a preset measured value, when the luminance setting screen according to the low luminance mode is displayed.

The measured value is a current value for maintaining white balance of the image.

The controller is configured to display a luminance setting screen in which a unit of an adjustable luminance value is changed, when the luminance setting screen according to the low luminance mode is displayed.

The controller is configured to: calculate a maximum luminance level capable of being supplied to the plurality of LED driver modules by comparing total power consumed by the plurality of LED driver modules with total power supplied by the at least one power supply unit, and set a luminance value corresponding to the calculated maximum luminance level as the maximum luminance value.

The system controller further comprises a memory configured to store a look-up table in which consumed power is mapped according to a luminance level of the LED driver modules, and the controller is configured to calculate a maximum luminance level providable to the plurality of LED driver modules based on the look-up table.

Effect of the Invention

According to embodiments of the present invention, by limiting settable maximum luminance according to the number of power supply units (PSUs), it is possible to minimize the case where a user sets higher luminance than luminance capable of being provided by the PSUs and to minimize the case where a product is damaged due to overcurrent flowing in a display device.

In addition, as maximum luminance is limited, a luminance settable range and a luminance unsettable range are displayed together, such that a user may be informed of a luminance settable range.

In addition, when a user wants to change luminance to a luminance value belonging to a luminance unsettable range, a luminance limit warning window is displayed, such that user is informed of a reason why luminance is not settable or a method of increasing luminance.

In addition, when maximum luminance is very low, it is possible to expand a luminance range which may be selected by a user by lowering a current value supplied by power supply units.

In addition, when maximum luminance is very low, an adjustment unit of a changeable luminance value is changed, such that it is possible to minimize a problem that luminance is not changed even when a luminance value is adjusted and to improve reliability.

BEST MODE

Figure 1:
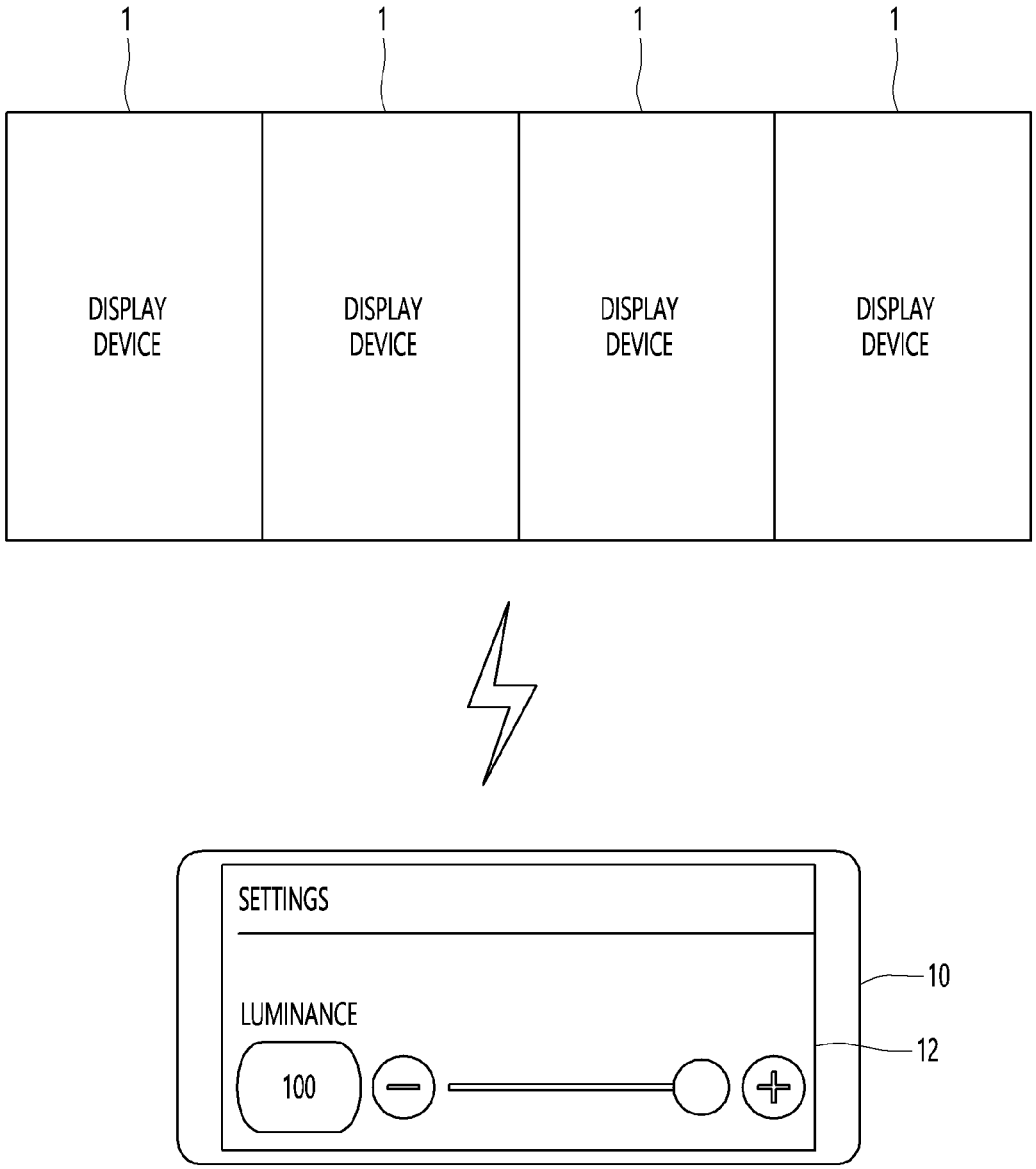
FIG. 1 is a schematic diagram of a digital signage system according to an embodiment of the present disclosure.

Hereinafter, exemplary embodiments disclosed in the present specification will be described in detail with reference to the accompanying drawings, but identical or similar elements are denoted by the same reference numerals regardless of reference numerals, and redundant descriptions thereof will be omitted. The suffixes "module" and "unit" for constituent elements used in the following description are given or used interchangeably in consideration of only the ease of writing the specification, and do not have meanings or roles that are distinguished from each other.

In addition, in describing the embodiments disclosed in the present specification, when it is determined that a detailed description of related known technologies may obscure the gist of the embodiments disclosed in the present specification, the detailed description thereof will be omitted. In addition, the accompanying drawings are for easy understanding of the embodiments disclosed in the present specification, and the technical idea disclosed in the present specification is not limited by the accompanying drawings, and it should be understood to include all changes included in the spirit and scope of the present disclosure, equivalents or substitutes.

Terms including an ordinal number such as first and second may be used to describe various elements, but the elements are not limited by the terms. These terms are used only for the purpose of distinguishing one component from another component.

Singular expressions include plural expressions unless the context clearly indicates otherwise.

In the present application, terms such as "comprises" are intended to designate the presence of features, numbers, steps, operations, components, parts, or combinations thereof described in the specification, it is to be understood that it does not preclude and one or more other features, numbers, steps, operations, components, parts, presence of combinations thereof or the possibility of addition.

A digital signage system described in this disclosure may refer to a display bulletin board for conveying information using various IT technologies such as hardware, software, content and networks. Such digital signage systems may be installed in large places with a large transient population, such as terminals, government offices, bus stops, subways, airports, hotels or hospitals or places where people stay for a certain period of time, such as offices, elevators, movie theaters, restaurants, shopping malls or stores.

In addition, in stand-alone digital signage which is one of digital signage systems, signboards or bill-boards may be composed of a digital information display such as a plasma display panel (PDP), a liquid crystal display (LCD) or a light emitting diode (LED), and pre-made information and advertisement content may be stored in a memory and may be manually played. In networked digital signage, which is another digital signage system, information and advertisement content may be transmitted to a digital information display via a communication network and content transmission and device status management may be performed at the center.

Such a digital signage system is, for example, an intelligent network TV capable of supporting at least one of a broadcast reception function, a computer support function and an Internet function, and may include various interfaces such as a handwriting type input device, a touchscreen or a pointing device. In addition, such a digital signage system may support wired or wireless network and perform e-mail, web-browsing, banking or gaming through connection with the Internet and/or other digital apparatuses. Meanwhile, the digital signage system may use a standardized general-purpose operating system (OS) to support the above-described functions. Accordingly, the digital signage system may perform user-friendly functions by freely adding or deleting various applications on the general-purpose OS kernel.

FIG. 1 is a schematic diagram of a digital signage system according to an embodiment of the present disclosure.

As shown in FIG. 1, the digital signage system may include a plurality of display devices 1 and a system controller 10 for controlling the plurality of display devices 1.

The display devices 1 may output content. At this time, the content may include an image according to a broadcast signal, an image received from an external device, an image received from the system controller 10, etc.

The display devices 1 may communicate with the system controller 10 by wire or wirelessly.

The system controller 10 may be implemented by various electronic apparatuses such as a mobile terminal, a personal computer (PC) or a laptop.

The system controller 10 may be connected with the plurality of display devices 1 by wire or wirelessly to control each of the plurality of display devices 1. Specifically, the system controller 10 may set types of content to be output from the plurality of display devices 1, a content output time, etc. or may set the luminance, definition, color, color temperature, brightness, color density and contrast of the display devices 1.

Figure 2:
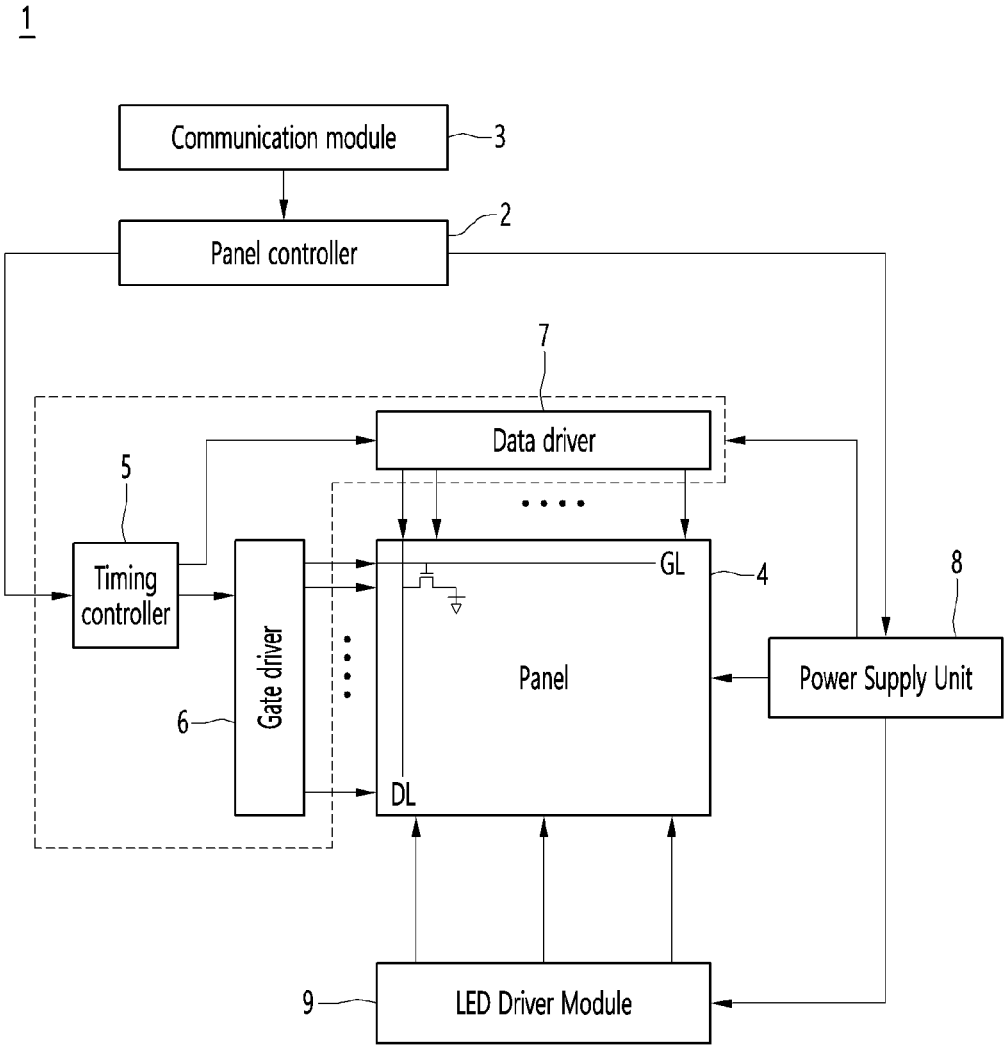
FIG. 2 is a block diagram of a display device according to an embodiment of the present disclosure.

FIG. 2 is a block diagram of a display device according to an embodiment of the present disclosure.

A display device 1 may include a panel controller 2, a communication module 3, a panel 4, a driving circuit, a power supply unit 8 and a light source. The driving circuit may include a timing controller 5, a gate driver 6 and a data driver 7. The light source may include an LED driver module 9.

The panel controller 2 may control operation of the display device 1. The panel controller 2 may control at least some or all of the communication module 3, the driving circuit, the power supply unit 8 and the light source.

The communication module 3 may include a broadcast reception module for receiving a broadcast signal, a mobile communication module for receiving a signal through a mobile communication network, a wireless Internet module for wireless Internet access, a short-range communication module, a position information module, etc.

The panel 4 may include a first substrate on which a plurality of gate lines GL and data lines DL for displaying an image is arranged to cross each other in a matrix form and thin-film transistors and pixel electrodes connected thereto are formed in intersecting regions, a second substrate having a common electrode provided thereon, and a liquid crystal layer formed between the first substrate and the second substrate. Meanwhile, a color filter for color display may be further disposed on the second substrate.

The driving circuit may drive the panel 4 based on a signal received from the panel controller 2.

The timing controller 5 may receive a control signal, R, G and B data signals and a vertical synchronization signal Vsync from the panel controller 2, control the gate driver 6 and the data driver 7 in correspondence with the control signal, rearrange the R, G and B data signals, and provide them to the data driver 7.

The gate driver 6 and the data driver 7 may supply scan signals and image signals to the panel 4 through the gate lines GL and the data lines DL under control of the timing controller 5.

The light source may supply light to the panel 4. The light source may include a plurality of LED driver modules 9, and the LED driver module 9 may include at least one light emitting diode (LED) and an LED controller for performing pulse width modulation (PWM) control with respect to the LED.

The LED controller may control on/off of the LED. In particular, the LED controller may adjust the luminance of a screen displayed on the panel 4 through PWM control for adjusting an on time of the LED.

The power supply unit (PSU) 8 may supply power to the panel 4, the driving circuit and the light source.

Meanwhile, the display device 1 may further include components other than the components shown in FIG. 2. For example, the display device 1 may further include a sound output unit for outputting a sound signal, an input unit for receiving user input and an interface connected with an external device.

Figure 3:
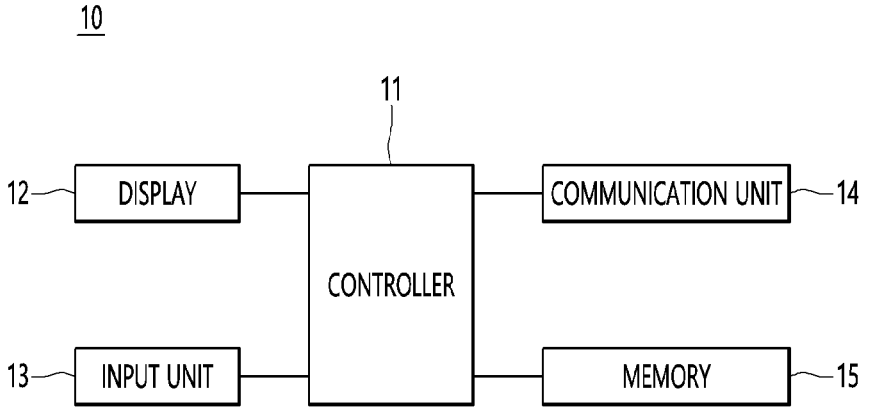
FIG. 3 is a block diagram of a system controller according to an embodiment of the present disclosure.

FIG. 3 is a block diagram of a system controller according to an embodiment of the present disclosure.

The system controller 10 may include at least some or all of a controller 11, a display 12, an input unit 13, a communication unit 14 and a memory 15.

The controller 11 may control operation of the system controller 10. The controller 11 may control at least some or all of the display 12, the input unit 13, the communication unit 14 and the memory 15.

The display 12 may display a screen for controlling the plurality of display devices 1. For example, the display 12 may display a luminance setting screen shown in FIG. 1, and a user may set the luminance of the display device 1 through the luminance setting screen displayed on the display 12 of the system controller 10.

The input unit 13 may receive information from the user and may include a mechanical input unit such as a button, a touch input unit, etc.

The communication unit 14 may transmit and receive signals to and from the plurality of display devices 1. The communication unit 14 may transmit image signals, control signals, etc. to each of the plurality of display devices 1.

The memory 15 may store a variety of information related to control of the display device 1. The memory 15 may store a variety of information such as an image signal output through the display device 1, a look-up table, in which consumed power of the LED driver module 9 is mapped according to a luminance level, and a luminance setting range.

Meanwhile, when the display device 1 is installed, the number of power supply units 8 for supplying power to the LED driver module 9 may be changed, and maximum luminance of the screen may be changed according to the number of power supply units 8. That is, the maximum luminance may increase as the number of the power supply units 8 increases when the display device 1 is installed, and may decrease as the number of the power supply units 8 decreases when the display device 1 is installed.

Even though the maximum luminance is changed, when the system controller 10 displays settable luminance fixedly, luminance set through the system controller 10 may be higher than luminance which may be provided by the display device 1. At this time, when higher luminance than providable luminance is provided to the display device 1, overcurrent may flow, thereby damaging a product.

Accordingly, the present disclosure is to limit settable maximum luminance based on the number of power supply units 8 when the display device 1 is installed. The controller 11 of the system controller 10 changes a settable maximum luminance value according to the number of power supply units 8 when the luminance setting screen is displayed.

Figure 4:
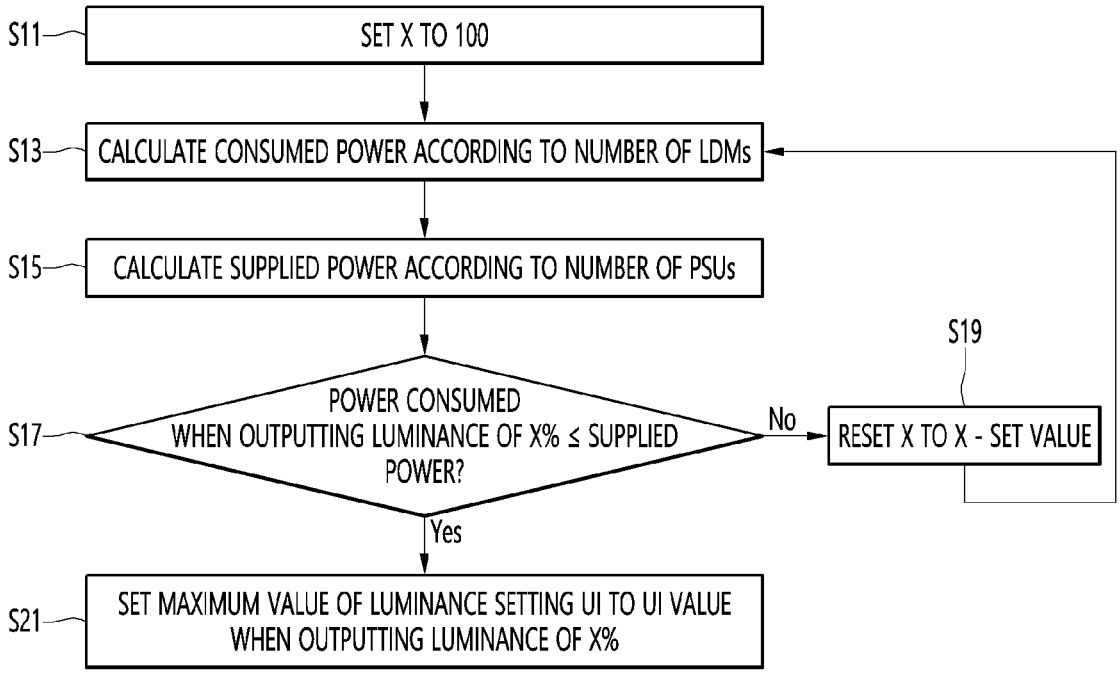
FIG. 4 is a flowchart illustrating a method of limiting maximum luminance in a digital signage system according to first embodiment of the present disclosure.

FIG. 4 is a flowchart illustrating a method of limiting maximum luminance in a digital signage system according to first embodiment of the present disclosure.

The system controller 10 may perform a maximum luminance limiting function immediately after installing the digital signage system.

The controller 11 of the system controller 10 may set X to 100 when the maximum luminance limiting function is performed (S11).

Here, X (%) means a luminance level and X may be a value between 0 and 100. When X is 100, this may mean that the LED is controlled with a duty cycle of 100% and, when X is 50, this may mean that the LED is controlled with a duty cycle of 50%.

The controller 11 may set an initial value of X to 100 which is a maximum level of the luminance level.

The controller 11 of the system controller 10 may calculate consumed power according to the number of LED driver modules (LDM) 9 (S13).

That is, the controller 11 may calculate total power consumed by the LED driver module 9 according to the value of X.

First, the controller 11 may detect the number of LED driver modules 9. The controller 11 may receive the number of LED driver modules 9 from the display device 1 or receive the number of LED driver modules 9 from the user through the input unit 13 and detect the number of LED driver modules 9.

The controller 11 may search for consumed power when the luminance level is X, based on the look-up table (LUT) stored in the memory 15, and multiply consumed power when the luminance level is X by the number of LED driver modules 9 to calculate total power consumed by the LED driver modules 9.

Table 1 below shows an example of the look-up table showing consumed power according to the luminance level per LED driver module 9.

For example, the controller 11 may calculate consumed power as 15 (W) when X is 100 and the number of LED driver modules 9 is 10.

TABLE 1

| X | Consumed power (W) |
|---|---|
| 100 | 1.5 |
| 99 | 1.4 |
| 98 | 1.35 |
| . . . | . . . |
| 2 | 0.5 |
| 1 | 0.3 |
| 0 | 0.1 |

The controller 11 of the system controller 10 may calculate supplied power according to the number of power supply units (PSUs) 8 (S15). The controller 11 may detect the number of power supply units 8 included in the display device 1. The controller 11 may receive the number of power supply units 8 from the display device 1 or receive the number of power supply units 8 from the user through the input unit 13, thereby detecting the number of power supply units 8.

In particular, the display device 1 may have an IP for each of at least one power supply unit 8. The panel controller 2 of the display device 1 may sense a current valid power supply unit 8 through an input IP for each of the power supply units 8 to calculate the number of power supply units 8. For example, the panel controller 2 of the display device 1 may calculate 8 as the number of power supply units 8 when eight power supply units 8 are sensed as a result of sensing operation information in an input state of ten power supply units 8.

The controller 11 may calculate total supplied power of the power supply units 8 by multiplying the detected number of power supply units 8 by power supplied by one power supply unit 8.

For example, the controller may calculate 10 (W) as supplied power when power supplied by one power supply unit 8 is 1 (W) and the number of power supply units 8 is detected as 10.

The controller 11 of the system controller 10 may determine whether consumed power is equal to or less than supplied power when outputting luminance of X % (S17).

The controller 11 may determine whether consumed power is equal to or less than supplied power by comparing the consumed power calculated in step S13 with supplied power calculated in step S15.

The controller 11 of the system controller 10 may reset X to X-set value when consumed power exceeds supplied power when outputting luminance of X % (S19).

That is, the controller 11 of the system controller 10 may reset the luminance level to a level lower than a current level when consumed power exceeds supplied power when outputting luminance of X %.

Here, the set value may mean a preset luminance level. For example, the set value may be Luminance level 5 and, in this case, X may be set to X−5. As another example, the set value may be an interval between luminance levels stored in the look-up table and, in this case, the controller 11 may set X to a luminance level lower than the current level by one level. That is, in the example of Table 1, the controller 11 may set X to 99 if consumed power exceeds supplied power when X is 100.

The controller 11 of the system controller 10 may repeat steps S13, S15 and S17 after X is reset.

The controller 11 of the system controller 10 may set a maximum value of a luminance setting user interface (UI) to a UI value when outputting luminance of X %, when consumed power when outputting luminance of X % is equal to or less than supplied power (S21).

That is, the controller 11 may set the UI value corresponding to a luminance level of X % to the maximum value of the luminance setting UI, when consumed power when outputting luminance of X % is equal to or less than supplied power.

For example, the controller 11 may determine that consumed power when outputting luminance of 85% is equal to or less than supplied power, and, at this time, may acquire a UI value corresponding to luminance output of 85%.

The controller 11 may variously set a luminance setting UI range. Here, the luminance setting UI range may mean a range of luminance values supported by the system controller 10 such that the user sets the luminance of the display device 1. That is, the luminance setting UI range may represent a range of luminance values displayed by the system controller 10. For example, the controller 11 may set the luminance setting UI range to 0 to 50 or 0 to 100.

For example, the UI value for outputting luminance of 85% when the luminance setting UI range is 0 to 50 may be 40, and the UI value for outputting luminance of 85% when the luminance setting UI range is 0 to 100 may be 85. Since the luminance setting UI range varies, the controller 11 may acquire a UI value for outputting luminance of X % and then set the acquired UI as a maximum value of a luminance setting UI. That is, the controller 11 may limit the luminance not to be set to a value exceeding a UI value corresponding to a luminance level of X % in the luminance setting UI range.

Figure 5:
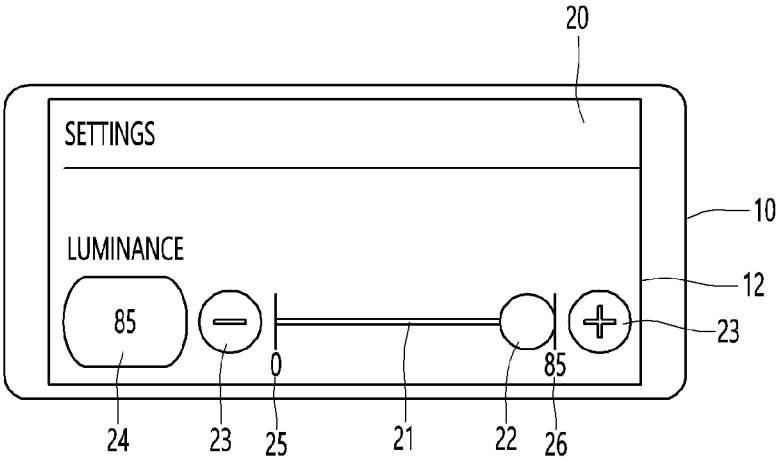
FIG. 5 is a view showing an example of a luminance setting screen when limiting maximum luminance according to a first embodiment of the present disclosure.

FIG. 5 is a view showing an example of a luminance setting screen when limiting maximum luminance according to a first embodiment of the present disclosure.

The controller 11 may display a luminance setting screen 20 according to the first embodiment of the present disclosure.

The luminance setting screen 20 may include a luminance range guide bar 21, a luminance selection indicator 22, a luminance change icon 23 and a current luminance indicator 24.

According to the first embodiment, the luminance range guide bar 21 may represent a luminance settable range according to maximum luminance limit.

The luminance range guide bar 21 may range from 0 to a maximum value of the luminance setting UI set in step S21.

For example, although the luminance setting UI range is 0 to 100, the controller 11 may set the maximum value of the luminance setting UI to 85 according to the maximum luminance limit. At this time, the luminance range guide bar 21 may indicate a selectable luminance range from 0 to 85.

The luminance range guide bar 21 may further include a minimum value 25 of a luminance settable UI and a maximum value 26 of the luminance settable UI.

The luminance selection indicator 22 may be movably displayed on the luminance range guide bar 21, and enable selection of one point on the luminance range guide bar 21.

The luminance change icon 23 may be an icon for adjusting the luminance selection indicator 22. The controller 11 may receive a selection command of the luminance change icon 23 to move the luminance selection indicator 22.

Alternatively, the controller 11 may move the luminance selection indicator 22 by a pointer (not shown) or touch input.

The current luminance indicator 24 may display a current luminance value selected through the luminance selection indicator 22.

The luminance setting screen 20 according to the first embodiment may display only a settable luminance UI value according to the maximum luminance limit and may not display a unsettable luminance UI value, thereby minimizing a problem that higher luminance than luminance providable through the power supply unit 8 is set.

Figure 6:
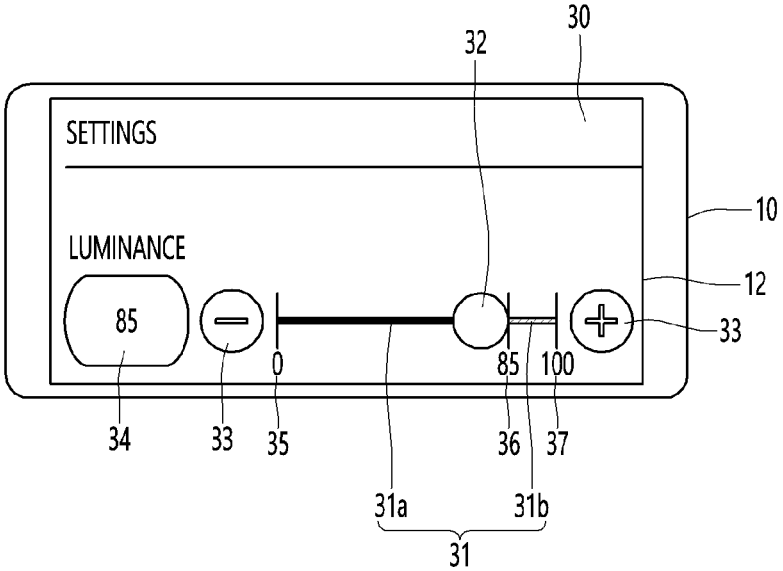
FIG. 6 is a view showing an example of a luminance setting screen when limiting maximum luminance according to a second embodiment of the present disclosure.

FIG. 6 is a view showing an example of a luminance setting screen when limiting maximum luminance according to a second embodiment of the present disclosure.

The controller 11 may display a luminance setting screen 30 according to the second embodiment of the present disclosure.

The luminance setting screen 30 may include a luminance range guide bar 31, a luminance selection indicator 32, a luminance change icon 33 and a current luminance indicator 34.

According to the second embodiment, the luminance range guide bar 31 may display a luminance setting UI range including a luminance settable range 31*a* and a luminance unsettable range 31*b*.

At this time, the luminance settable range 31*a* and the luminance unsettable range 31*b* may be differently displayed. The controller 11 may display the luminance settable range 31*a* to be distinguished from the luminance unsettable range 31*b*.

For example, the controller 11 may set transparency of the luminance unsettable range 31*b* to be higher than that of the luminance settable range 31*a*. As another example, the controller 11 may set the thickness of the luminance settable range 31*a* to be greater than that of the luminance unsettable range 31*b*.

For example, although the luminance setting UI range is 0 to 100, the controller 11 may set the maximum value of the luminance setting UI to 85 according to the maximum luminance limit. At this time, the luminance range guide bar 31 may include the luminance settable range 31*a* indicating 0 to 85 and the luminance unsettable range 31*b* indicating 86 to 100.

The luminance range guide bar 31 may be a minimum value 35 of a luminance settable UI, a maximum value 36 of the luminance settable UI and a maximum value 37 of a UI range.

The luminance selection indicator 32 may be movably displayed on the luminance range guide bar 31.

In particular, according to the second embodiment, the controller 11 may movably display the luminance selection indicator 32 in the luminance settable range 31*a*, and perform control such that the luminance selection indicator 32 is not displayed in the luminance unsettable range 31*b*.

For example, when user input of positioning the luminance selection indicator 32 on the luminance unsettable range 31*b* is received, the controller 11 may display the luminance selection indicator 32 at a position corresponding to the maximum value 36 of the luminance settable UI in the luminance settable range 31*a*.

Figure 7:
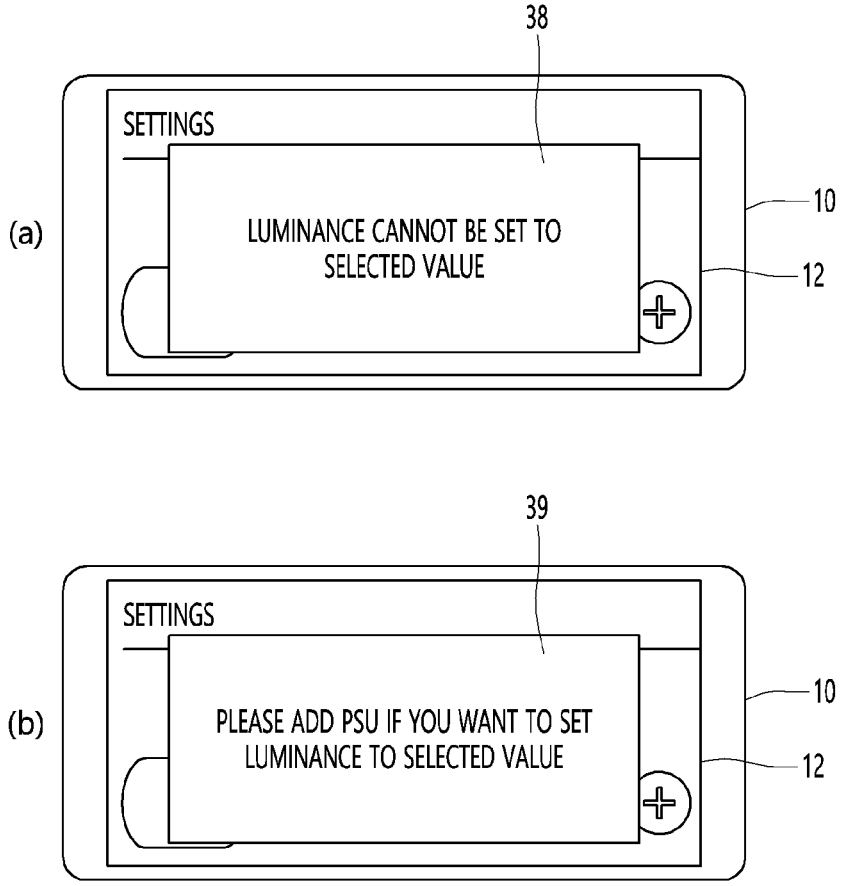
FIG. 7 is a view showing an example of a luminance limit warning window according to an embodiment of the present disclosure.

As another example, when user input of positioning the luminance selection indicator 32 in the luminance unsettable range 31*b* is received, the controller 11 may display a luminance limit warning window shown in FIG. 7.

FIG. 7 is a view showing an example of a luminance limit warning window according to an embodiment of the present disclosure.

According to an embodiment, the controller 11 may display a luminance limit warning window 38 including an unsettable notification message as shown in FIG. 7(*a*). For example, the unsettable notification message may be "Luminance cannot be set to a selected value".

According to another embodiment, the controller 11 may display a luminance limit warning window 39 including a PSU addition proposal message as shown in FIG. 7(*b*). For example, the PSU addition proposal message may be "Please add a PSU if you want to set luminance to a selected value".

However, the luminance limit warning window shown in FIG. 7 is merely an example, and the controller 11 may output a luminance limit warning notification using various methods when receiving user input of positioning the luminance selection indicator 32 in the luminance unsettable range 31*b*.

FIG. 6 will be described again.

The luminance change icon 33 may adjust the luminance selection indicator 32. The controller 11 may receive a selection command of the luminance change icon 33 to move the luminance selection indicator 32.

Alternatively, the controller 11 may move the luminance selection indicator 32 by a point (not shown) or touch input.

The current luminance indicator 34 may display a current luminance value selected through the luminance selection indicator 32.

The luminance setting screen 30 according to the second embodiment may display both the luminance settable range 31*a* and the luminance unsettable range 31*b*, such that the user may be informed of the luminance setting UI range and the settable maximum luminance UI value.

In addition, the luminance setting screen 30 according to the second embodiment may limit luminance settings to a UI value corresponding to the luminance unsettable range 31*b*, thereby minimizing a problem that higher luminance than luminance providable by the power supply unit 8 is set.

In addition, the luminance setting screen 30 according to the second embodiment may display a luminance limit warning window when receiving user input of setting luminance to a UI value corresponding to the luminance unsettable range 31*b*, such that the user may be informed of the reason why luminance is not settable or a method of increasing settable maximum luminance.

Meanwhile, when maximum luminance is limited, if the limited maximum luminance is very low, a problem that luminance is not changed even if a UI value is changed by 1 through a luminance setting screen may be generated.

For example, the LED driver module 9 inputs a PWM value from 0 to 255 to the LED to adjust luminance (LED is driven with a duty cycle of 0% when the PWM value is 0, is driven with a duty cycle of 25% when the PWM value is 64, is driven with a duty cycle of 75% when the PWM value is 127 and is driven with a duty cycle of 100% when the PWM value is 255). When the limited maximum luminance is very low, the PWM value may be limited to 0 to 50 (50 steps). In this case, when the luminance setting UI range is 0 to 100, even if the user adjusts the UI value by 1, the PWM value is not adjusted and thus there is a problem that luminance is not changed. This is because, when the user adjusts the UI value by 2, the PWM value is adjusted by 1 to change luminance.

Accordingly, in a low luminance mode in which luminance is less than a predetermined criterion, an adjustable luminance UI range may expand by reducing current supplied to the LED driver module 9.

Figure 8:
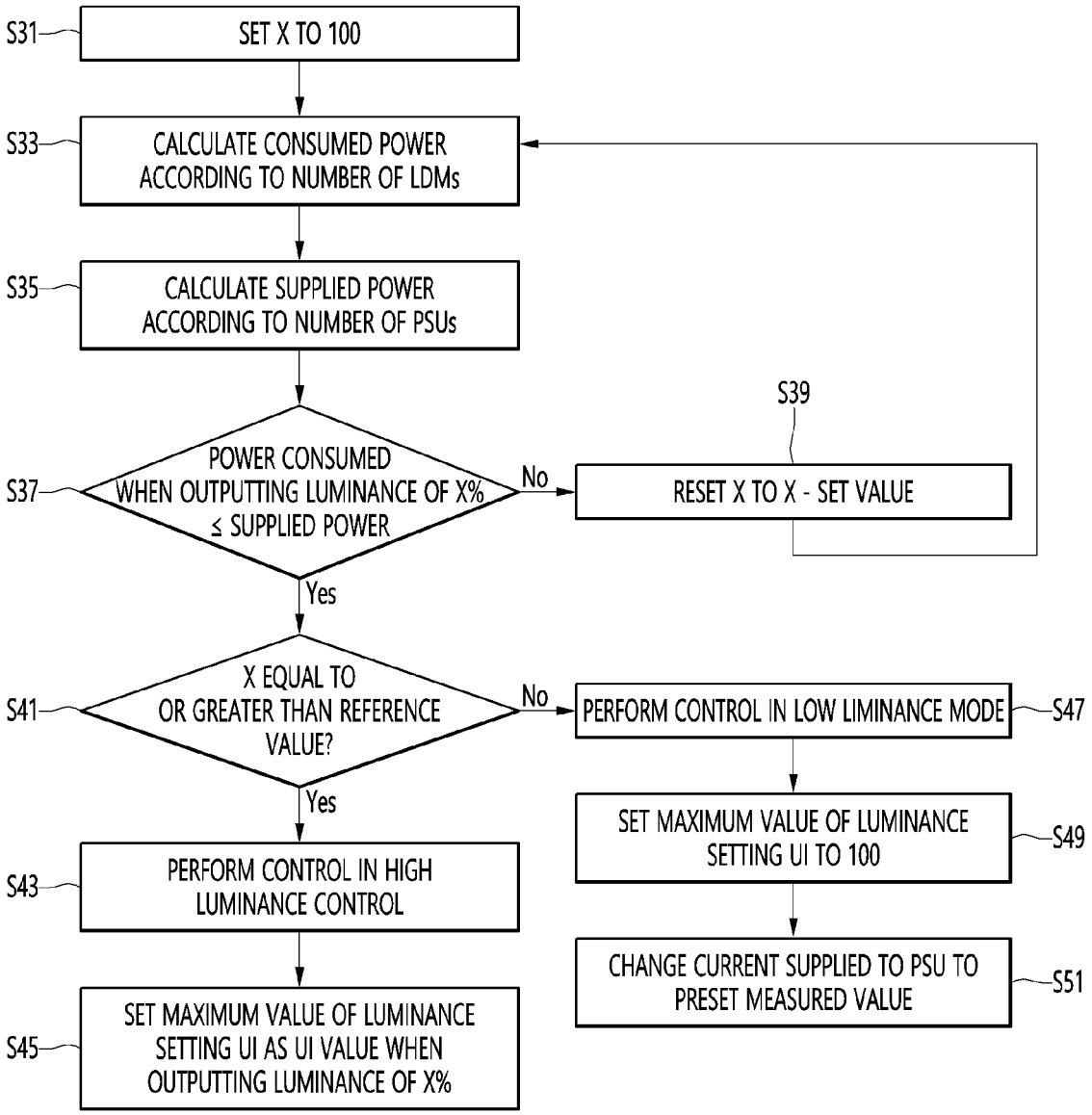
FIG. 8 is a flowchart illustrating a method of limiting maximum luminance in a digital signage system according to a second embodiment of the present disclosure.

FIG. 8 is a flowchart illustrating a method of limiting maximum luminance in a digital signage system according to a second embodiment of the present disclosure.

The controller 11 may display a luminance setting screen according to a high luminance mode or a luminance setting screen according to a low luminance mode based on the number of the plurality of LED driver modules 9 or the number of power supply units 9.

Specifically, the controller 11 of the system controller 10 may set X to 100 (S31), calculate consumed power according to the number of LED driver modules (LDMs) (S33), calculate supplied power according to the number of PSUs (S35), and determine whether consumed power is equal to or less than supplied power when outputting luminance of X % (S37). When consumed power exceeds supplied power when outputting luminance of X %, X may be reset to X-the set value (S39), and steps S33, S35 and S37 may be repeated.

Steps S31, S33, S35, S37 and S39 are respectively equal to steps S11, S13, S15, S17 and S19 described with reference to FIG. 4 and a detailed description thereof will be omitted.

The controller 11 of the system controller 10 may determine whether X is equal to or greater than a reference value when consumed power when outputting luminance of X % is equal to or less than supplied power (S41).

Here, the reference value may mean a reference luminance level for determining whether a luminance setting screen according to a high luminance mode or a luminance setting screen according to a low luminance mode is displayed when displaying the luminance setting screen.

The controller 11 may preset the reference value. Specifically, the controller 11 may set a luminance level, at which the range of the PWM value is less than half of the luminance setting UI range, as the reference value. For example, the controller 11 may set the reference value to 50.

When X is equal to or greater than the reference value, the controller 11 may perform control in the high luminance mode (S43), and set the maximum value of the luminance setting UI to a UI value when outputting luminance of X %.

That is, the controller 11 may limit maximum luminance in the same manner as described in step S21 of FIG. 4 when performing control in the high luminance mode. The controller 11 may display a luminance setting screen in the same manner described with reference to FIGS. 5 to 7 when performing control in the high luminance mode.

Meanwhile, when X is less than the reference value, the controller 11 may perform in the low luminance mode (S47).

The controller 11 may display a luminance setting screen in which a luminance range selectable by the user expand, by reducing current supplied to the LED control module 9, when performing control in the low luminance mode.

The controller 11 may set the maximum value of the luminance setting UI to 100 (S49).

Specifically, the controller 11 may display a luminance setting screen selectable from 0 to 100. In this case, the controller 11 may perform control to output a luminance level of X % when the luminance setting UI is 100. That is, the controller 11 may set the maximum value of the luminance setting UI to 100 and perform control to drive the LED with a duty cycle of X % when luminance is set to 100 which is the UI maximum value. Therefore, it is possible to minimize a problem that higher luminance than luminance providable through the power supply unit 8 is set and to increase a UI range selectable by the user.

At this time, the range of the PWM value may also be from 0 (0%) to 255 (100%).

The controller 11 may change current supplied by the power supply unit (PSU) to a preset measured value (S51).

Here, the measured value may be a value set by previously measuring current to be supplied from the power supply unit (PSU) to the LED driver module 9 for each luminance level less than the reference value. At this time, the measured value may be a value measured as maintaining white balance even when current supplied to the LED driver module 9 decreases.

Accordingly, the controller 11 may decrease current supplied to the LED driver module 9 by the power supply unit 8 according to the measured value. In this case, even if the user sets luminance to a maximum value on the luminance setting screen, since current supplied to the LED driver module 9 by the power supply unit 8 is low, consumed power may be equal to or less than supplied power.

Accordingly, the controller 11 may provide a user selectable luminance range from 0 to 100.

Figure 9:
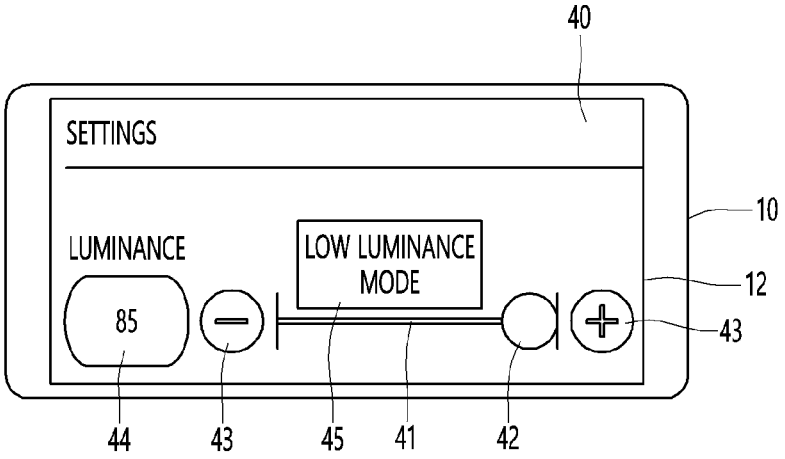
FIG. 9 is a view showing an example of a luminance setting screen in a low luminance mode according to a first embodiment of the present disclosure.

FIG. 9 is a view showing an example of a luminance setting screen in a low luminance mode according to a first embodiment of the present disclosure.

As shown in FIG. 9, the controller 11 may display a luminance setting screen 40 in the low luminance mode according to the first embodiment.

The luminance setting screen 40 may include a luminance range guide bar 41, a luminance selection indicator 42, a luminance change icon 43, a current luminance indicator 44 and a low luminance indicator 45.

The luminance range guide bar 41 indicates a luminance settable range and may include a luminance range selectable in a range from 0 to 100 in the low luminance mode. That is, in the low luminance mode, the luminance range guide bar 41 with an expanded luminance selection range may be displayed.

The luminance selectin indicator 42 may be movably displayed on the expanded luminance range guide bar 41.

The luminance change icon 43 may adjust the luminance selection indicator 42.

The current luminance indicator 44 may display a current luminance value selected through the luminance selection indicator 42.

However, the luminance value herein may be different from the luminance value in the high luminance mode. For example, current supplied to the LED driver module 9 when the luminance value is 100 in the low luminance mode may be different from current supplied to the LED driver module 9 when the luminance value is 100 in the high luminance mode. Accordingly, a luminance value displayed on the current luminance indicator 44 in the low luminance mode may be different from a luminance displayed on the luminance indicator 44 in the high luminance mode.

The low luminance indicator 45 may indicate that the luminance setting screen is a luminance setting screen according to the low luminance mode. The user may be informed that the luminance value displayed on the current luminance indicator 44 is different from the luminance value displayed on the luminance indicator in the high luminance mode, through the low luminance indicator 45. The user may recognize that current supplied to the LED driver module 9 decreases through the low luminance indicator 45.

According to the luminance setting screen 40 in the low luminance mode according to the first embodiment, it is possible to expand the selectable luminance range through the luminance range guide bar 41 while minimizing a problem that higher luminance than luminance providable through the power supply unit 8 is set.

Meanwhile, when control is performed in the low luminance mode in step S47 of FIG. 8, differently from the method shown in steps S49 and S51, the adjustment unit of the luminance setting UI may be changed.

According to the second embodiment of the present disclosure, the controller 11 of the system controller 10 may change the adjustment unit of the luminance setting UI at the time of control in the low luminance mode.

That is, the controller 11 may change the adjustment unit of the luminance setting UI when a luminance level X, at which consumed power is equal to or less than supplied power, is less than a reference value. Specifically, the controller 11 may change the adjustment unit of the luminance setting UI such that the minimum unit of a changeable UI value is equal to or greater than 2. For example, the controller 11 may perform control such that the UI value is changed by 1 in the high luminance mode and is changed by 2 in the low luminance mode. That is, the controller 11 may set the minimum change UI value (e.g., 2) in the low luminance mode to be greater than the minimum change UI value (e.g., 1) in the high luminance mode.

Therefore, it is possible to minimize a problem that a UI value is changed but luminance is not changed in a low luminance mode.

Figure 10:
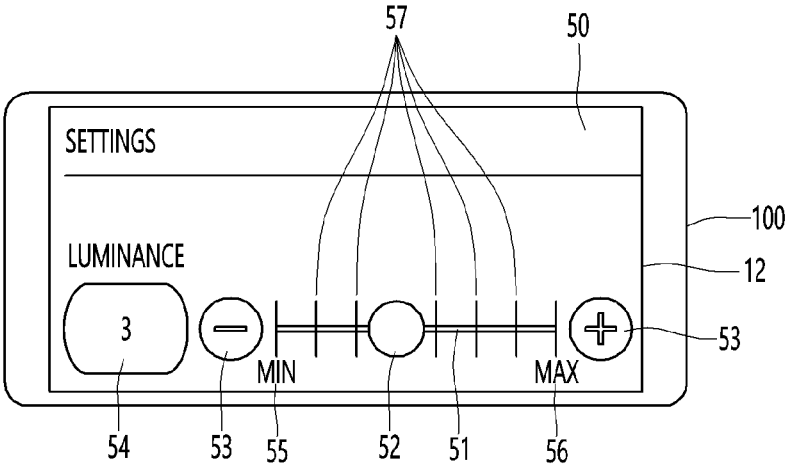
FIG. 10 is a view showing an example of a luminance setting screen in a low luminance mode according to a second embodiment of the present disclosure.

FIG. 10 is a view showing an example of a luminance setting screen in a low luminance mode according to a second embodiment of the present disclosure.

In the low luminance mode according to the second embodiment, a luminance setting screen 50 may include a luminance range guide bar 51, a luminance selection indicator 52, a luminance change icon 53 and a current luminance indicator 54.

The luminance range guide bar 51 may indicate a luminance settable range according to maximum luminance limit.

The luminance range guide bar 51 may include at least one of a minimum value 55 of a luminance settable UI, a maximum value 56 of the luminance settable UI or a UI adjustment indicator 57.

The UI adjustment indicator 57 may inform the user of selectable UI values as the adjustment unit of the luminance setting UI is changed.

The luminance selection indicator 52 may be movably displayed on the UI adjustment indicator 57 in the luminance range guide bar 51.

The luminance change icon 53 moves the luminance selection indicator 52. When an input command of the luminance change icon 53 is received, the luminance selection indicator 52 may be moved on the UI adjustment indicator 57.

The current luminance indicator 54 may display a selected current luminance value through the luminance selection indicator 52.

In the low luminance mode according to the second embodiment, the luminance setting screen 50 may enable the user to select one of UI values in which luminance change occurs when luminance is set, thereby minimizing a problem that luminance is not changed even when the user changes a luminance UI value.

The above description is merely illustrative of the technical idea of the present disclosure, and those skilled in the art to which the present disclosure pertains may make various modifications and variations without departing from the essential characteristics of the present disclosure.

Therefore, the embodiments disclosed in the present disclosure are not intended to limit the technical spirit of the present disclosure, but to explain, and the scope of the technical spirit of the present disclosure is not limited by these embodiments.

The scope of protection of the present disclosure should be interpreted by the claims below, and all technical spirits within the scope equivalent thereto should be interpreted as being included in the scope of the present disclosure.

The invention claimed is:

1. A digital signage system comprising:

a panel configured to display an image;

a plurality of light emitting diode (LED) driver modules configured to provide light to the panel;

a display device including at least one power supply unit configured to supply power to the panel and the plurality of LED driver modules; and a system controller configured to control the display device, wherein the system controller comprises:

a display configured to display a luminance setting screen for controlling luminance of the image; and a second controller configured to change a settable maximum luminance value according to the number of power supply units when the luminance setting screen is displayed.

2. The digital signage system of claim 1, wherein the second controller is configured to display a luminance range guide bar having a range from 0 to the maximum luminance value when the luminance setting screen is displayed.

3. The digital signage system of claim 1, wherein the second controller is configured to display a luminance range guide bar including a luminance settable range and a luminance unsettable range according to the maximum luminance value when the luminance setting screen is displayed.

4. The digital signage system of claim 3, wherein the second controller is configured to differently display the luminance settable range and the luminance unsettable range.

5. The digital signage system of claim 4, wherein the second controller is configured to display a luminance limit warning window when a command for selecting a luminance value belonging to the luminance unsettable range is received.

6. The digital signage system of claim 3, wherein the second controller is configured to further display a minimum luminance value on the luminance range guide bar, a maximum luminance value on the luminance range guide bar and a settable maximum luminance value.

7. The digital signage system of claim 1, wherein the second controller is configured to display a luminance setting screen according to a high luminance mode or a luminance setting screen according to a low luminance mode based on the number of the plurality of LED driver modules and the number of power supply units.

8. The digital signage system of claim 7, wherein the second controller is configured to:

calculate a maximum luminance level among luminance levels at which total power consumed by the plurality of LED driver modules is equal to or less than total power supplied by the at least one power supply unit, display a luminance setting screen according to a high luminance mode when the calculated maximum luminance level is equal to or greater than a reference value, and display a luminance setting screen according to a low luminance mode when the calculated maximum luminance level is less than the reference value.

9. The digital signage system of claim 7, wherein the second controller is configured to display a luminance setting screen for limiting a settable maximum luminance value when the luminance setting screen according to the high luminance mode is displayed.

10. The digital signage system of claim 7, wherein the second controller is configured to:

display a selectable luminance setting screen in a range from 0 to 100 when the luminance setting screen according to the low luminance mode is displayed, and adjust current supplied to the plurality of LED driver modules by the power supply unit.

11. The digital signage system of claim 10, wherein the second controller adjusts current supplied to the plurality of LED driver modules by the power supply unit to a preset measured value, when the luminance setting screen according to the low luminance mode is displayed.

12. The digital signage system of claim 11, wherein the measured value is a current value for maintaining white balance of the image.

13. The digital signage system of claim 7, wherein the second controller is configured to display a luminance setting screen in which a unit of an adjustable luminance value is changed, when the luminance setting screen according to the low luminance mode is displayed.

14. The digital signage system of claim 1, wherein the second controller is configured to:

calculate a maximum luminance level capable of being supplied to the plurality of LED driver modules by comparing total power consumed by the plurality of LED driver modules with total power supplied by the at least one power supply unit, and set a luminance value corresponding to the calculated maximum luminance level as the maximum luminance value.

15. The digital signage system of claim 14, wherein the system controller further comprises a memory configured to store a look-up table in which consumed power is mapped according to a luminance level of the LED driver modules, and wherein the second controller is configured to calculate a maximum luminance level providable to the plurality of LED driver modules based on the look-up table.

* * * * *